US005791863A

United States Patent [19]

Droegemueller

[11] Patent Number: 5,791,863

[45] Date of Patent: Aug. 11, 1998

[54] COUPLING SYSTEM

[76] Inventor: David Droegemueller, 27451 W.C.R. 388, Kersey, Colo. 80644

[21] Appl. No.: 757,018

[22] Filed: Nov. 26, 1996

Related U.S. Application Data

[63] Continuation-in-part of Ser. No. 189,178, Jan. 31, 1994, Pat. No. 5,584,644.

[51] Int. Cl.[6] ..... E02F 3/28

[52] U.S. Cl. ..... 414/723; 37/468

[58] Field of Search ..... 414/723; 37/468; 403/20, 321, 324; 172/272–275

[56] References Cited

U.S. PATENT DOCUMENTS 5,332,353 7/1994 Arnold ..... 414/723

5,584,644 12/1996 Droegemueller ..... 414/723

*Primary Examiner*—Donald W. Underwood

*Attorney, Agent, or Firm*—Dean P. Edmundson

[57] ABSTRACT

A coupling system for connecting or attaching a working tool to the free end of a working arm. For example, a bucket, hammer, etc. can be easily attached to the end of an articulated arm on an excavator. The coupling system includes a fixed jaw and a movable jaw which is pivotable between open and closed positions. The movable jaw includes a tab which extends through an opening in the coupler housing. A single pin is used to lock the movable jaw in its closed position.

8 Claims, 3 Drawing Sheets

COUPLING SYSTEM

CROSS-REFERENCE TO RELATED APPLICATION

This application is a continuation-in-part of my copending application Ser. No. 08/189,178, filed Jan. 31, 1994, now U.S. Pat. No. 5,584,644.

FIELD OF THE INVENTION

This invention relates to coupling systems for mounting a working tool to the end of a working arm, e.g., an articulating arm of an excavating machine. More particularly, this invention relates to a coupling system which enables a tool to be quickly attached to or detached from a working arm.

BACKGROUND OF THE INVENTION

Excavating machines, backhoes, etc. have a large articulated working arm with a tool attached to the free end of the arm. For example, a bucket may be attached to the arm, or a heavy chisel or hammer may be attached to the arm. Because of the great weight and size of the tools, it is difficult and cumbersome to change from one type of tool to another tool to be mounted on the arm.

Normally a tool is attached to the free end of the articulated arm by means of two heavy pins which must be inserted through registering openings in the arm and the tool. This is difficult and cumbersome. It can also lead to injury to the workmen involved in handling the large pins.

Although a number of hitch or coupling assemblies have been described for connecting a tool to the end of a working arm, none of such assemblies has been entirely effective. In U.S. Pat. No. 4,881,867 (Essex) there is described an attachment device with a pair of jaws, with one of the jaws being hydraulically movable between an extended and a retracted position. The jaws are intended to engage the transverse hinge pins of a bucket, hammer, or other tool. The disadvantages of this type of attachment device include the fact that a hydraulic line could become damaged or otherwise rendered inoperative so that the movable jaw may move to its retracted position while the apparatus is being used. As a result, the tool attached to the end of the working arm may come loose. This could cause damage to the tool or other property or could even result in personal injury if the tool should happen to fall on someone. Also, if the hydraulic cylinder is not completely extended to connect the fingers to the pin, a dangerous situation could be presented because the fingers could slip off the pin.

In U.S. Pat. No. 4,810,162 (Foster) there is described an attachment device also having a pair of jaws. One of the jaws is fixed and the other is hinged and can pivot between open and closed positions. The jaws are for engaging the hinge pins of a bucket or tool. A spring biases the movable jaw to its open position. A latch retains the movable jaw in a locked position.

Because of the offset pin locations used in the attachment device, the tool which is attached to the end of a working arm is closer to the operator than is desired. As a result, the operator cannot see the lock because he is on the opposite side of the working arm. Thus, the operator has no way to assure that the lock is properly applied or in its fully-latched position. Consequently, if the lock is not completely latched, the movable jaw could come loose during use of the equipment. This could result in loss of the tool during operation, leading to property damage or personal injury.

In U.S. Pat. No. 5,082,389 (Balemi) there is described a connecting device for implements and it includes a fixed jaw and a hydraulically-operated closure member. The disadvantages of this type of connecting device include those described above with respect to the Essex patent.

U.S. Pat. No. 4,726,731 (Jones) describes a quick release hitch which includes a pair of pivoting jaws for engaging the hinge pins of an implement. Both of the jaws must be pivotably moved with a linkage system in order to engage the hinge pins. The disadvantages of this device include those described above with respect to Essex patent.

U.S. Pat. No. 4,013,182 (Pratt) describes a detachable coupling system for attaching an implement to a prime mover. The system includes a collapsible assembly having transverse bars which can be moved toward each other or away from each other. The implement includes spaced-apart hook members which are engaged by the transverse bars when the bars are moved apart from each other. The main disadvantage of this coupling system is that it would not be suitable for coupling an existing bucket or other tool to the free end of a working arm.

U.S. Pat. No. 1,429,389 (Weintz) describes a gate latch which includes pivoting latch members which engage a gate post and may be locked in a closed position. Such disclosure does not teach anything in regards to attachment systems for connecting a tool to the free end of a working arm.

The present invention provides a simple and effective coupling system having several advantages for detachably connecting a tool to the free end of a working arm.

SUMMARY OF THE PRESENT INVENTION

In accordance with the present invention there is provided a coupling system for quickly and easily connecting a tool (e.g., a bucket, hammer, etc.) to the free end of a working arm (e.g., an articulated arm on an excavator). The coupling system of the invention comprises:

(a) a plate member having upper and lower surfaces and having an opening therein;

(b) attachment means on the upper surface for securing the plate member to the working arm;

(c) first and second jaw means carried by the lower surface of the plate member; wherein the first jaw means is fixed and the second jaw means is pivotable between open and closed positions; wherein the second jaw means includes a tab member which extends through the opening in the plate member when the second jaw means is in the closed position; and (d) lock means for locking the second jaw means in the closed position.

The coupling system of the invention is very advantageous because it is easy and safe to operate. After the fixed jaw is aligned with one of the hinge pins of a tool (e.g., a bucket), movement of the working arm causes the tool to be properly aligned with the movable jaw. Then the movable jaw can be pivoted to its closed position and locked when the tab member extends through the opening in the base plate. This secures the working tool to the working arm.

The coupler system of this invention is very safe in use because it requires positive actions to lock the movable jaw in its closed position. No hydraulic operation is required, which therefore avoids the problems which are inherent in hydraulic systems. The movable jaw must be in its proper closed position before it can be secured and locked. Until the movable jaw is locked, the coupler system cannot lift a tool. This renders the coupler system very safe.

Other advantages of the coupling system of the invention will be apparent from the following detailed description.

BRIEF DESCRIPTION OF THE DRAWINGS

The invention is described in more detail hereinafter with reference to the accompanying drawings, wherein like reference characters refer to the same parts throughout the several views and in which.

DETAILED DESCRIPTION OF THE INVENTION

Figure 1:
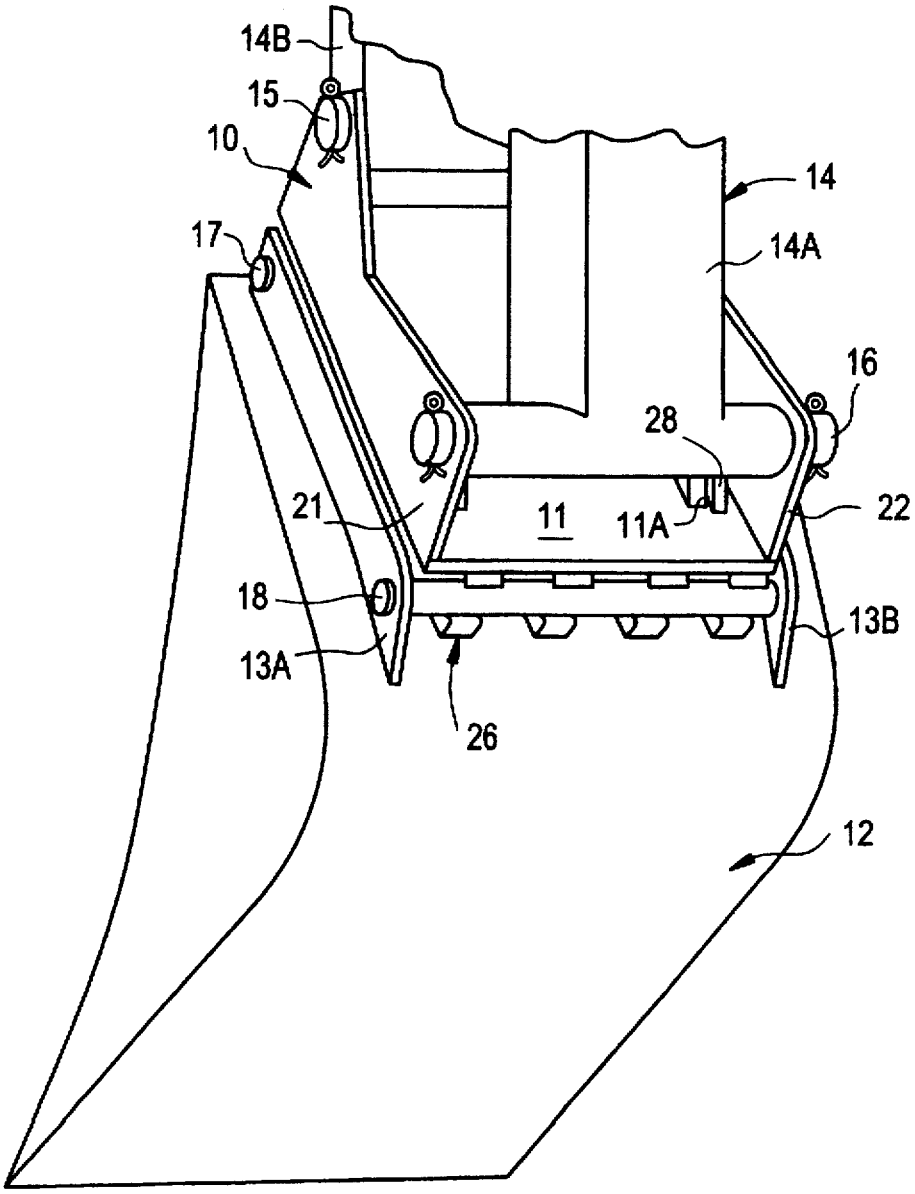
FIG. 1 is a perspective view of one embodiment of coupling system of the invention attached between the free end of a working arm of an excavator and a tool (e.g., a bucket)
Figure 2:
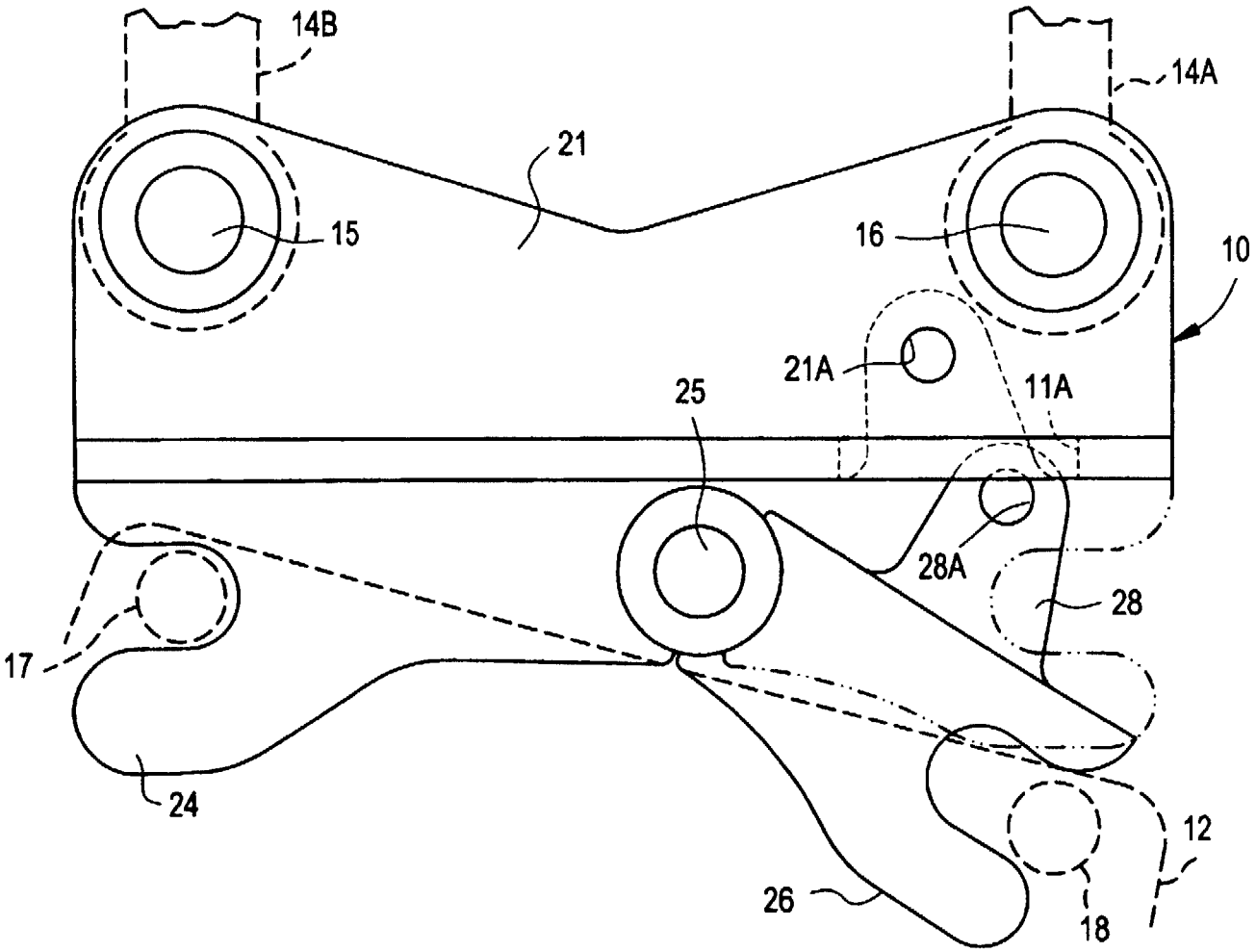
FIG. 2 is a side elevational view of the coupling system of FIG. 1 with the movable jaw in its open position.

The coupling system of the invention is illustrated in the drawings. In FIGS. 1 and 2 the coupling system 10 is shown being used to connect a working tool (i.e., bucket 12) to the free end of a working arm 14 (e.g., the end of an excavator arm). The working arm includes two links 14A and 14B which are attached to the upper surface of the coupling system 10 by means of elongated pins 15 and 16 which extend through the upright wall members 21 and 22.

The bucket 12 includes spaced-apart mounting brackets 13A and 13B. Elongated pins 17 and 18 serve to connect the bucket 12 to the coupling system 10.

The coupling system 10 includes a horizontal plate member 11 from which the wall members 21 and 22 extend upwardly. Secured to the lower surface of plate 11 is a fixed jaw 24 which is open on one end so as to slidingly engage pin 17. Also secured to the lower surface of plate 11 is a second jaw 26 which is pivotably mounted by means of pin 25. The jaw 26 is pivotable between an open position and a closed position (which is shown in FIGS. 1 and 2).

At least one, and preferably two, tab members 28 extend upwardly from, and are secured to, the upper surface of movable jaw 26. Each tab 28 includes an aperture 28A extending therethrough. When the jaw 26 is pivoted to its closed position, the tab 28 passes through opening 11A in plate 11. When the opening 21A in wall 21 and opening 28A in tab 28 are in alignment with each other, a locking pin can be inserted therethrough to positively and securely lock the movable jaw 28 in its closed position. Thus, the locking pin(s) cannot be inserted until the aperture 28A in tab 28 is in proper alignment with opening 21A in wall 21 (or a similar opening in wall 22). In other words, the coupling system of the invention cannot be used to lift a working tool until the movable jaw 26 is in its locked position. The locking pin(s) cannot be inserted until the jaw 26 is in its fully-closed position. This is an important safety feature.

Preferably there is an upright tab adjacent each opening 11A which includes an aperture corresponding to, and in alignment with, aperture 21A in wall 21 (or corresponding to a similar aperture in wall 22). This provides additional support for each locking pin to lock jaw 26 in its closed position.

Figure 3:
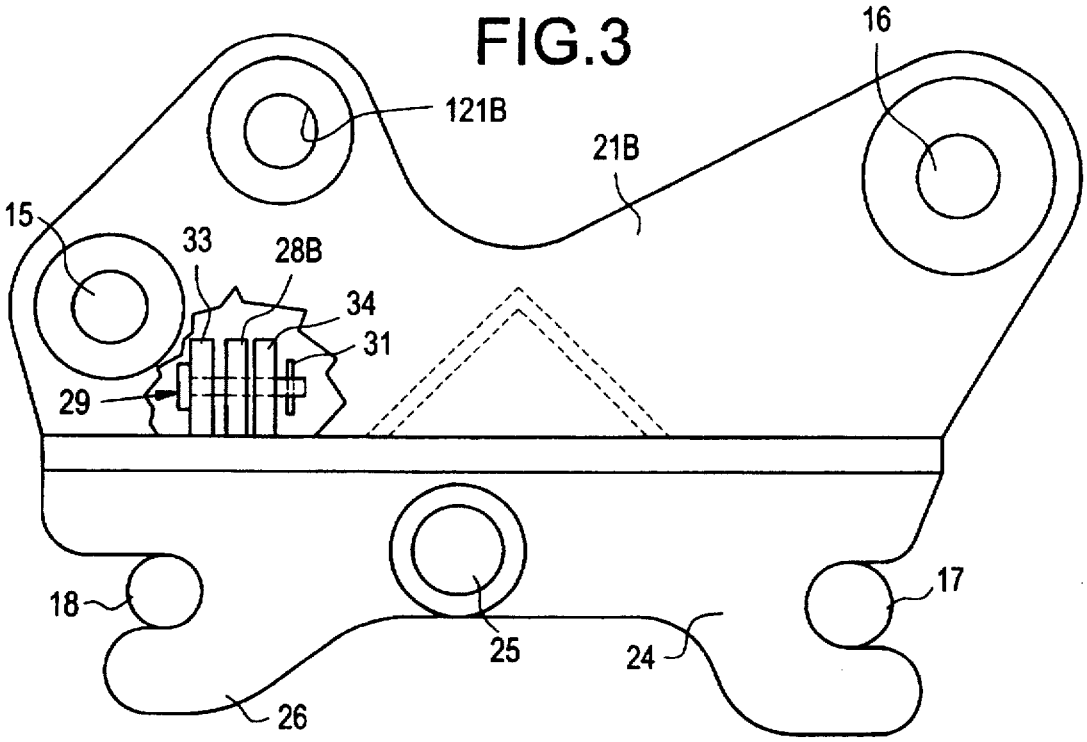
FIG. 3 is a side elevational view of another embodiment of coupling system with the movable jaw in its closed position.
Figure 4:
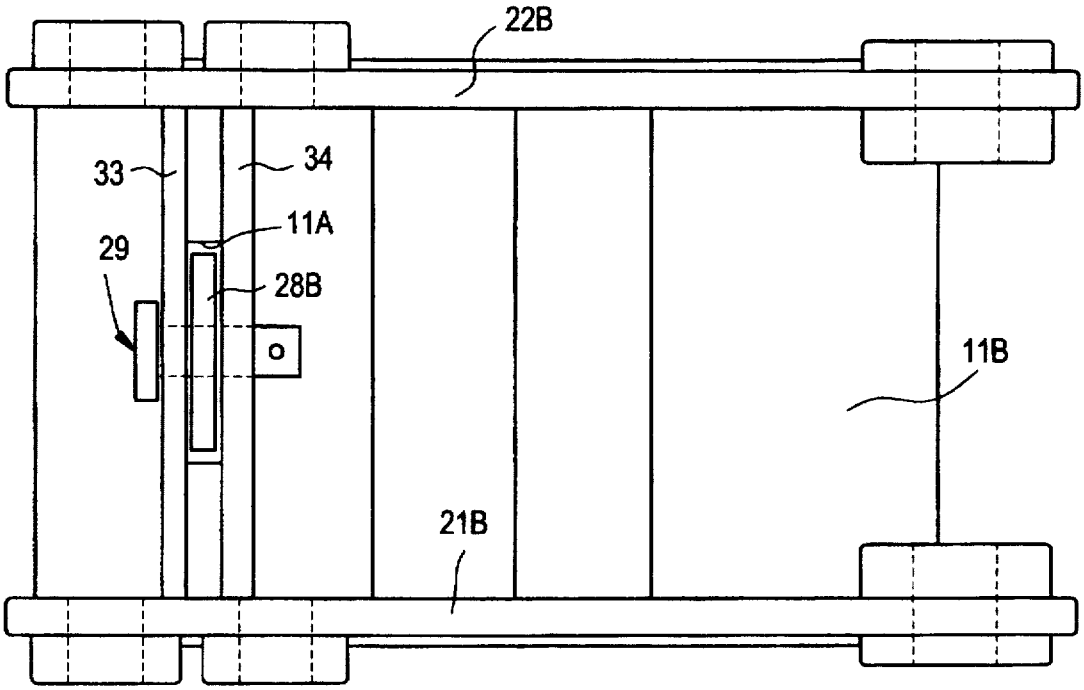
FIG. 4 is a top view of the coupling system shown in FIG. 3.

FIGS. 3 and 4 illustrate another embodiment of coupling system comprising upright wall members 21B and 22B which are adapted to receive pins 15 and 16 to connect the coupling system to appropriate links on the end of a working arm (e.g., the end of an excavator arm). A third pin can also be used, if necessary, and is inserted through opening 121B. The wall members extend upwardly from a plate member 11B.

A fixed jaw 24 is secured to the lower surface of the plate 11B. A second jaw 26 is pivotably mounted to the plate by means of pin 25, and this jaw is movable between open and closed positions.

A single tab member 28B extends upwardly from, and is secured to, jaw 26. This tab is preferably centrally positioned between the wall members 21B and 22B, as shown. It also is preferably perpendicular to the walls 21B and 22B. The tab includes an aperture through it to enable a locking pin 29 to be easily inserted through registering openings in parallel bar members 33 and 34 secured to the upper surface of plate member 11B when jaw 26 is in its closed position. A cotter pin 31 can then be inserted through an opening in the end of locking pin 29 to prevent it from falling out during use.

The locking pin 29 effectively and safely locks the movable jaw 26 in its closed position for use. The position and orientation of the bar members 33 and 34, and aperture 11A in plate 11B, enable the locking pin 29 to be inserted very easily.

Other variants are possible without departing from the scope of this invention.

What is claimed is:

1. A coupling system for detachably connecting a tool to the free end of a working arm, said coupling system comprising:

(a) a plate member having upper and lower surfaces; wherein said plate member includes an opening therein; wherein said plate member further includes bar members positioned adjacent said opening;

(b) attachment means on said upper surface for securing the plate member to the working arm;

(c) first and second jaw means carried by said lower surface of said plate member; wherein said first jaw means is fixed and said second jaw means is pivotable between open and closed positions; wherein said second jaw means includes a tab member secured thereto; wherein said tab member extends through said opening in said plate member when said second jaw means is in said closed position;

wherein said tab includes an aperture extending therethrough; and (d) lock means for locking said second jaw means in said closed position; wherein said lock means comprises a pin for engaging said aperture and said bar members; wherein said coupling system is unable to lift said tool until said second jaw means is locked in said closed position.

2. A coupling system in accordance with claim 1, wherein said first and second jaw means each comprise a plurality of spaced-apart, parallel jaw fingers.

3. A coupling system in accordance with claim 1, wherein said first and second jaw means lie in the same plane when said second jaw means is in said closed position.

4. A coupling system in accordance with claim 1, wherein upright wall members are attached along opposite edges of the upper surface of said plate member, and wherein said opening in said plate member is centrally located between said wall members.

5. A coupling system in accordance with claim 4, wherein said bar members are positioned adjacent opposite edges of said opening in said plate member; wherein said bar members are perpendicular to said wall members.

6. A coupling system in accordance with claim 5, wherein said bar members each include an opening therethrough enabling said pin to be received through each said opening and said aperture to thereby lock said second jaw means in said closed position.

7. A coupling system for detachably connecting a tool to the free end of a working arm, said coupling system comprising:

(a) a horizontal plate member having upper and lower surfaces; wherein said plate member includes an opening therein; wherein said plate member further includes bar members positioned adjacent said opening;

(b) attachment means on said upper surface for securing the plate member to the working arm;

(c) first and second jaw means carried by said lower surface of said plate member; wherein said jaw means each comprise a plurality of spaced-apart, parallel jaw fingers; wherein said first jaw means is fixed and said second jaw means is pivotable between open and closed positions; wherein said second jaw means includes a tab member secured thereto; wherein said tab member extends through said opening in said plate member when said second jaw means is in said closed position wherein said tab member includes an aperture extending therethrough;

and (d) lock means for locking said second jaw means in said closed position; wherein said lock means comprises a pin for engaging said aperture and said bar members;

wherein said coupling system is unable to lift said tool until said second jaw means is locked in said closed position.

8. A coupling in accordance with claim 7, wherein upright wall members are attached along opposite edges of the upper surface of said plate member, and wherein said lock opening is centrally located between said wall members.

* * * * *